US009429119B2

(12) United States Patent
Reimer

(10) Patent No.: US 9,429,119 B2
(45) Date of Patent: Aug. 30, 2016

(54) INJECTION VALVE WITH DIRECT AND SERVO DRIVE

(75) Inventor: Attila Reimer, Neutraubling (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 730 days.

(21) Appl. No.: 13/703,641

(22) PCT Filed: Jun. 9, 2011

(86) PCT No.: PCT/EP2011/059542

§ 371 (c)(1),
(2), (4) Date: Mar. 28, 2013

(87) PCT Pub. No.: WO2011/157613

PCT Pub. Date: Dec. 22, 2011

(65) Prior Publication Data

US 2013/0200180 A1 Aug. 8, 2013

(30) Foreign Application Priority Data

Jun. 14, 2010 (DE) ..... 10 2010 023 698

(51) Int. Cl.
*F02M 51/00* (2006.01)
*F02M 47/02* (2006.01)
(Continued)

(52) U.S. Cl.
CPC ..... *F02M 47/027* (2013.01); *F02M 45/08* (2013.01); *F02M 51/061* (2013.01); *F02M 51/0603* (2013.01); *F02M 63/0005* (2013.01); *F02M 63/0017* (2013.01); *F02M 63/0026* (2013.01); *F02M 63/0028* (2013.01); *F02M 63/0043* (2013.01); *F02M 2200/702* (2013.01)

(58) Field of Classification Search
CPC ..... F02M 47/027; F02M 63/0026; F02M 51/0603; F02M 2200/702; F02M 63/0028; F02M 63/0005; F02M 45/08; F02M 63/0043; F02M 51/061; F02M 63/0017
USPC ..... 239/102.2, 585.1
See application file for complete search history.

(56) References Cited

U.S. PATENT DOCUMENTS 4,753,212 A 6/1988 Miyaki et al. ..... 123/506
5,732,678 A 3/1998 Lindquist et al. ..... 123/446
(Continued)

FOREIGN PATENT DOCUMENTS

CN 86102235 A 11/1986 ..... F02D 1/02
CN 1105098 A 7/1995 ..... F01L 9/02
(Continued)

OTHER PUBLICATIONS

International Search Report and Written Opinion, Application No. PCT/EP2011/059542, 9 pages, Aug. 9, 2011.
(Continued)

*Primary Examiner* — Jason Boeckmann
(74) *Attorney, Agent, or Firm* — Slayden Grubert Beard PLLC

(57) ABSTRACT

A valve device for conveying a liquid includes a housing, a valve needle which is arranged such that it can be deflected in a valve-needle chamber of the housing, and a drive device for the valve needle, wherein the drive device comprises an electric drive component which brings about a direct deflection of the valve needle. Furthermore, the drive device includes a hydraulic drive component which can be activated in addition to the electric drive component and brings about a ballistic deflection of the valve needle.

17 Claims, 4 Drawing Sheets

(51) Int. Cl.

| | |
|---|---|
| ***F02M 45/08*** | (2006.01) |
| ***F02M 51/06*** | (2006.01) |
| ***F02M 63/00*** | (2006.01) |

(56) References Cited

U.S. PATENT DOCUMENTS

| | | | | |
|---|---|---|---|---|
| 6,067,955 | A | 5/2000 | Boecking | 123/299 |
| 6,595,436 | B2 | 7/2003 | Kirzhner et al. | 239/102.2 |
| 7,946,509 | B2 | 5/2011 | Boecking | 239/125 |
| 2002/0013653 | A1 | 1/2002 | Ohyama et al. | 701/103 |
| 2010/0213270 | A1* | 8/2010 | Graupner | F02D 41/2096 239/5 |
| 2011/0162623 | A1* | 7/2011 | Hayashi et al. | 123/472 |
| 2013/0200180 | A1 | 8/2013 | Reimer | 239/584 |

FOREIGN PATENT DOCUMENTS

| | | | | |
|---|---|---|---|---|
| CN | 1241244 | A | 1/2000 | F02M 45/04 |
| DE | 10220498 | A1 | 11/2002 | F02M 51/06 |
| DE | 102005041994 | A1 | 3/2007 | F02M 45/00 |
| DE | 102006036444 | A1 | 10/2007 | F02M 57/02 |
| DE | 102008042136 | A1 | 3/2010 | F02M 47/02 |
| WO | 2004/076848 | A1 | 9/2004 | F02M 47/02 |
| WO | 2008/017538 | A1 | 2/2008 | F02M 47/02 |
| WO | 2011/157613 | A1 | 12/2011 | F02M 45/08 |

OTHER PUBLICATIONS

Chinese Office Action, Application No. 201180029540.7, 12 pages, Apr. 16, 2014.

* cited by examiner

INJECTION VALVE WITH DIRECT AND SERVO DRIVE

CROSS-REFERENCE TO RELATED APPLICATIONS

This application is a U.S. National Stage application of International Application No. PCT/EP2011/059542 filed Jun. 9, 2011, which designates the United States of America, and claims priority to DE Application No. 10 2010 023 698.5 filed Jun. 14, 2010, the contents of which are hereby incorporated by reference in their entirety.

TECHNICAL FIELD

The disclosure relates to a valve apparatus for delivering lubricating and non-lubricating liquids, e.g., for use in the field of fuel injection in an internal combustion engine. The valve apparatus may have a two-stage drive device which comprises both an electric direct drive and also a hydraulic servo drive. Here, the servo drive may be activated in addition to the direct drive if a greater valve needle stroke is required.

BACKGROUND

Valve apparatuses are used for the delivery and/or distribution of a wide variety of liquids. Such valve apparatuses may be formed for example as so-called injection valves, in which the opening of an injection nozzle is controlled very precisely by means of a valve needle. By means of a modern injection valve, it is thus possible for even extremely small liquid quantities to be accurately metered. Such accuracy is required for example in internal combustion engines in which fuel is injected at high pressure into the combustion chamber by means of corresponding fuel injectors. Here, the fuel must be supplied in precisely predefined quantities and at predefined times. For the conditioning of the combustion process, the fuel injection valve of a modern internal combustion engine generally performs multiple injections, wherein the fuel quantity used is varied depending on the injection phase. Relatively small fuel quantities are typically injected for the pilot injection, whereas relatively large fuel quantities are delivered into the combustion chamber during the main injection.

The spectrum of fuel quantities required in the individual phases of the fuel injection in an internal combustion engine constitutes an important criterion in the design of a suitable injection valve. For example, the drive device provided for moving the valve needle must be designed to be large enough to ensure the maximum needle stroke required during the main injection. On the other hand, it must also be possible for the valve needle to be controlled quickly and precisely enough to permit an optimum injection of small or extremely small fuel quantities during the pilot injection.

A drive device typically used for deflecting the valve needle therefore has an electric drive means, for example a piezoelectric or electromagnetic actuator. In said drive concept, the actuator acts as a direct drive, wherein the valve needle, owing to mechanical contact with components of the drive, is deflected out of its closed position by directly following the deflection or expansion of the actuator. The direct drive thus permits particularly fast switching times and precise regulability, in particular in combination with closed loop regulation. The switching travel that can be realized in this way is however limited to the maximum deflection of the actuator. In the case of a piezo stack, this is for example only approximately 60 to 70 micrometers. Such a small needle stroke is however not expedient for the delivery of relatively large liquid quantities. To overcome said disadvantage, a more complex construction of the direct drive is required, which manifests itself inter alia in high production costs.

To realize a greater valve needle stroke, use may also be made of hydraulic drive devices. In said drive concept, a hydraulic force which effects the deflection of the valve needle is generated utilizing different pressure conditions within the valve apparatus. In the hydraulic drive activated for example by means of a servo valve, the deflection of the valve needle takes place in the form of ballistic flight, thus permitting a considerably greater needle stroke in relation to the electric direct drive. However, owing to the indirect response of the valve needle to the control, the possibilities for closed loop regulation and thus also a precise injection of extremely small liquid quantities are severely limited with said drive concept.

SUMMARY

In one embodiment, a valve apparatus is provided for delivering a liquid, having a housing, having a valve needle which is arranged, such that it can be deflected, in a valve needle chamber of the housing, and having a drive device for the valve needle, wherein the drive device comprises an electric drive component which effects a direct deflection of the valve needle, wherein the drive device also comprises a hydraulic drive component which can be activated in addition to the electric drive component and which effects a ballistic deflection of the valve needle.

In a further embodiment, the drive device is designed to effect the activation of the hydraulic drive component by means of the electric drive component. In a further embodiment, the hydraulic drive component is in the form of a servo valve which connects the valve needle chamber to a low-pressure duct, wherein the servo valve comprises a valve element which can be moved from a closed position into an open position by the deflection of the electric drive component. In a further embodiment, the deflection of the electric drive component leads to an activation of the hydraulic drive component only after an activation threshold is overcome, and the activation threshold is predefined by a tolerance in the mechanical transmission path from the electric drive component to the valve element. In a further embodiment, the mechanical transmission path from the electric drive component to the valve element comprises at least one mechanical transmission element which transmits the deflection of the electric drive component to the valve element of the hydraulic drive component. In a further embodiment, the transmission element is of pin-like form. In a further embodiment, the mechanical transmission path comprises a lever-like transmission element which is actuated by the pin-like transmission element. In a further embodiment, between the two transmission elements, a tolerance is provided which permits a deflection of the valve needle by a predefined distance without an activation of the hydraulic drive component taking place.

In a further embodiment, the electric drive component comprises a piezo element which effects the desired deflection when an electrical voltage is applied. In a further embodiment, the electric drive component is operated by means of closed loop regulation. In a further embodiment, the valve apparatus is formed as an injection valve for injecting fuel into a combustion chamber of an internal combustion engine.

BRIEF DESCRIPTION OF THE DRAWINGS

Exemplary embodiments will be explained in more detail below on the basis of the schematic drawings, wherein.

DETAILED DESCRIPTION

Figure 1:
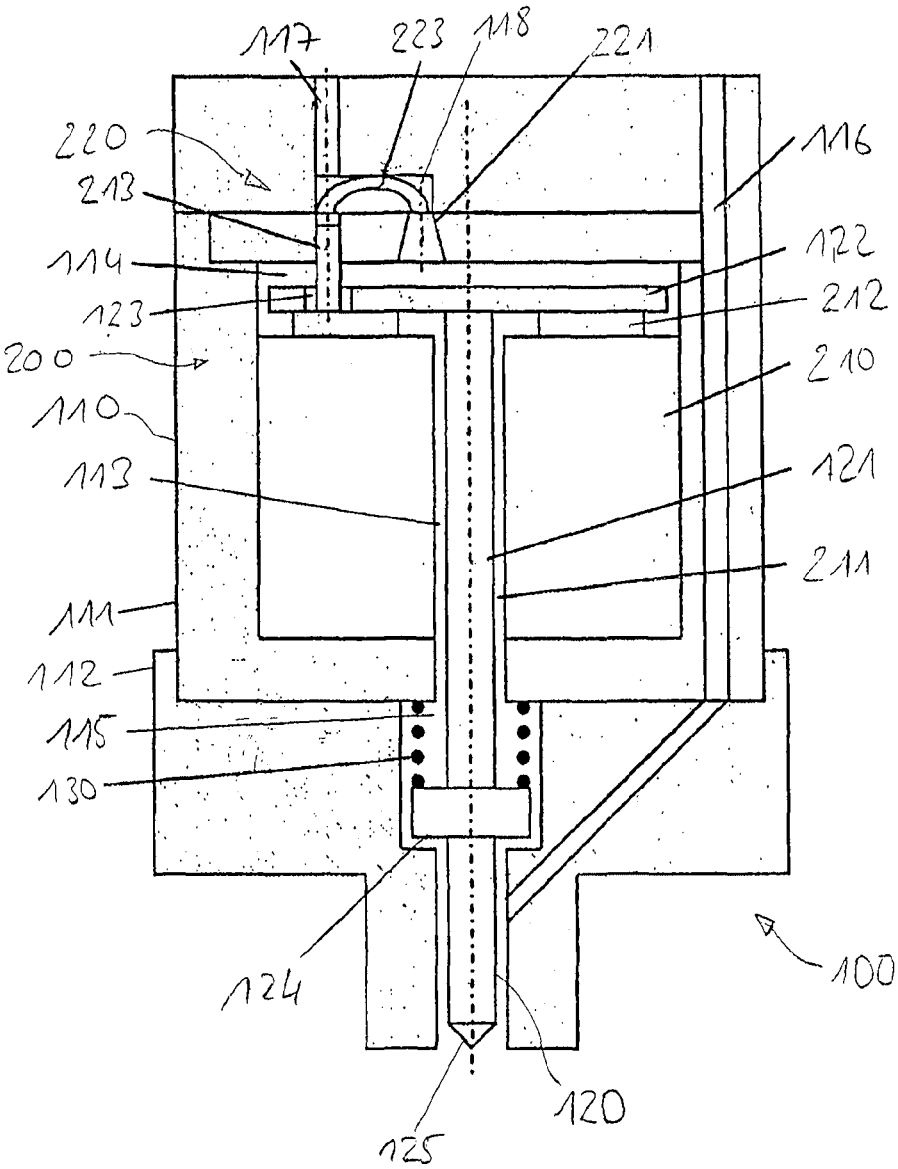
FIG. 1 shows a valve apparatus which is formed as an injection valve and which has a drive device according to an example embodiment.

Some embodiments provide a drive concept for a valve apparatus for delivering liquids, which drive concept permits both precise dispensing of small liquid quantities and also a greater valve needle stroke for delivering greater liquid quantities.

In some embodiments, a valve apparatus for delivering a liquid has a housing, a valve needle which is arranged, such that it can be deflected, in a valve needle chamber of the housing, and a drive device for the valve needle. Here, the drive device comprises an electric drive component which effects a direct deflection of the valve needle, and a hydraulic drive component which can be activated in addition to the electric drive component and which effects a ballistic deflection of the valve needle. As a result of the combination of the two drive concepts in the drive device, it is possible for the advantages of both drives to be utilized. The electric drive component which acts as a direct drive permits highly precise valve needle control for the injection of small liquid quantities. Owing to the fast response behavior of the valve needle, the direct drive can also be combined with closed loop regulation, whereby the precision of the valve needle control can be increased. By contrast, by means of the hydraulic drive component, it is possible to realize a relatively large deflection of the valve needle, and thus the injection of relatively large liquid quantities, for example during the main injection phase. The combination of the two drive concepts is also associated with a reduction in production costs, because only a relatively short piezo stack is required.

In a first embodiment, it is provided that the drive device is designed to effect the activation of the hydraulic drive component by means of the electric drive component. An automatic activation of the hydraulic drive component is permitted in this way. Since, in this case, the two operating modes, specifically "purely electric operation" and "mixed operation" are controlled merely by the means used for controlling the electric drive component, a simplified and thus also less expensive design is thus made possible.

In a further embodiment, it is provided that the hydraulic drive component is in the form of a servo valve which connects the valve needle chamber to a low-pressure duct, wherein the servo valve comprises a valve element which is moved from a closed position into an open position by the deflection of the electric drive component. Such servo valves permit a relatively large needle stroke. The direct activation of the valve element by the deflection of the electric drive component makes it possible to realize a particularly simple automatic activation of the hydraulic drive component.

A further embodiment provides that the deflection of the electric drive component leads to an activation of the hydraulic drive component only after an activation threshold is overcome, wherein the activation threshold is predefined by a tolerance in the mechanical transmission path from the electric drive component to the valve element. By determining the tolerance, it is possible in a particularly simple manner to define the maximum needle stroke that can be effected by means of the electric drive component without activation of the hydraulic drive.

In a further embodiment, it is provided that the mechanical transmission path from the electric drive component to the valve element comprises at least one mechanical transmission element, by means of which the deflection of the electric drive component is transmitted to the valve element of the hydraulic drive component. The use of mechanical transmission elements permits an optimization of the transmission of the movement of the electric drive to the valve element and thus of the opening behavior of the valve element. Furthermore, with mechanical transmission elements, it is particularly easily possible to realize tolerances which permit an activation of the hydraulic component only after a predefined needle stroke is overcome.

A further embodiment provides that the transmission element is of pin-like form. This permits a direct and therefore simple transmission of the movement of the electric drive to the valve element.

A further embodiment provides that the mechanical transmission path comprises a lever-like transmission element which is actuated by the pin-like transmission element. By means of the lever-like transmission element, the deflection of the electric drive component can be converted as desired into a movement for activating the valve element. In particular, it is possible to reverse the movement direction, such that the valve element is opened counter to the deflection direction of the electric drive component.

A further embodiment provides that, between the two transmission elements, a tolerance is provided which permits a deflection of the valve needle by a predefined distance without an activation of the hydraulic drive component taking place. In this way, it is possible in a simple manner to realize an automatic activation of the hydraulic drive component which takes place only beyond a predefined needle stroke, that is to say only after an activation threshold is overcome.

In a further embodiment, the electric drive component comprises a piezo element which effects the desired deflection when an electrical voltage is applied. Such piezo elements have a fast response behavior, as a result of which they can be used optimally, in particular in combination with suitable regulation, for precise control of the valve needle. This is advantageous in particular for the injection of extremely small liquid quantities. Furthermore, piezo elements can be produced relatively inexpensively.

In a further embodiment, it is provided that the electric drive component is operated by means of closed loop regulation. The precision of the valve needle control can be increased considerably in this way.

Finally, a further embodiment provides that the valve apparatus is formed as an injection valve for injecting fuel into a combustion chamber of an internal combustion engine. Owing to the combined properties of the two drive concepts, the valve apparatus may be particularly suitable for the pilot injection and the main injection in an internal combustion engine. In the case of an injection valve, the increased needle stroke of the combined drive in relation to the purely electric drive furthermore permits a more expedient nozzle needle angle, which can have a positive effect on the combustion parameters.

FIG. 1 shows a valve apparatus 100 according to an example embodiment for delivering lubricating and non-lubricating liquids. The valve apparatus illustrated here may be a fuel injection valve for an internal combustion engine of a motor vehicle. The injection valve 100 comprises a housing 110. The housing, which is generally of multi-part construction, comprises an upper and a lower housing part 111, 112, wherein the division of the housing may vary depending on the application. The valve apparatus 100 also comprises a valve needle 120 which is arranged in a valve needle chamber 113 in the interior of the housing 110. The valve needle 120 controls an injection nozzle (not shown here) which is provided in the lower part of the housing 110 and through which highly pressurized fuel is discharged into the combustion chamber. Here, the fuel is supplied via a high-pressure duct 116 which runs in the housing 110.

The valve needle 120 is mounted so as to be movable in the axial direction and typically comprises a shank-like portion 121, on the lower end of which is formed a valve needle tip 125 which serves as a closure element for the orifice of the injection nozzle. To ensure that the injection valve closes fully, the valve needle 120 may be held in its valve seat by means of spring force. For this purpose, in the present example, a spiral compression spring 130 is provided which is accommodated in a spring chamber 150 formed by a part of the valve needle chamber 113. The compression spring 130, which acts on a collar-like valve needle part 124, exerts a pressure in the downward direction on the valve needle 120. To open the injection valve, the valve needle 120 is therefore deflected upward counter to the spring force of the compression spring 130. For this purpose, a drive device 200 is provided which may be integrated in the housing 110 of the valve apparatus 100. The drive device 200 comprises an electric drive component 210 which serves as a direct drive. For this purpose, use may be made of basically any suitable electrically operated actuator that is controlled by means of electrical signals, for example current or voltage pulses. In injection valves, therefore, use is often made of actuators which are composed of piezoelectric materials and in which a change in the electrical voltage applied thereto leads to an expansion or contraction. Such piezo actuators are typically produced as so-called piezo stacks which are formed from a plurality of piezoelectric layers arranged one above the other. Furthermore, use is also made of electromagnetic actuators in which the desired deflection is effected by application of corresponding current pulses.

In the present case, the electric drive component is formed by a piezo stack 210. The piezo stack 210, which is accommodated in an inner housing chamber, is of cylindrical form and has a central bore 211 for receiving the shank-like part 121 of the valve needle 120. As shown in FIG. 1, the piezo stack 210 does not completely fill out the inner housing chamber, as a result of which a pressure chamber 114 for receiving a plate structure 121 of the valve needle 120 is formed above the piezo stack 210. Here, the plate structure 121 forms the upper termination of the valve needle 120 and is connected to the shank-like valve needle part 121, which runs within the bore 211. Against the cylindrical piezo stack 210 there bears a disk-like annular element 212, which serves to support the valve needle plate 121. During the expansion of the piezo stack 210, the valve needle plate 122 is driven by the annular element 212 arranged thereunder, whereby the valve needle 120 is deflected counter to the force of the compression spring 130, and the nozzle orifice is opened up. Owing to the mechanical contact between the piezo stack 210, annular element 212 and valve needle plate 122 during the deflection, the valve needle 120 reacts directly to the movement of the piezo stack 210. Very fast and precise control of the valve needle 120 is thus possible in particular in combination with closed loop regulation. In purely direct operation, however, the deflection of the valve needle 120 is limited by the maximum deflection of the piezo stack 210.

The drive device 200 may therefore additionally include a hydraulic drive 220 which, in the present case, is in the form of a servo valve which connects the pressure chamber 114 to a low-pressure duct 117. Here, the servo valve 220 comprises a conical valve element 221 which closes off a likewise conically shaped valve orifice in the upper cover element of the pressure chamber 114. A curved lever element 223 which is arranged in a side chamber 118 of the low-pressure duct 117 serves to open the servo valve 220, which lever element acts on the valve element 221 and is actuated by means of a pin-like transmission element 213. The pin-like transmission element 213 is arranged so as to be guided in a bore of the upper cover element of the pressure chamber 114 and bears with its lower end on the annular element 212. For this purpose, a corresponding opening with a tolerance adequate for the pin-like transmission element 213 is provided in the plate-like termination element 122 of the valve needle 120. Here, the two transmission elements 213, 223 may be formed such that they do not make contact when the valve apparatus 200 is in the closed state, and the actuation of the curved transmission element 223 thus takes place only after a distance predefined by the spacing 214 of said transmission element is overcome. It may be ensured in this way that the hydraulic drive component 220 is activated only after an activation threshold is overcome, that is to say only beyond a relatively large deflection of the valve needle 120 by means of the piezo stack 210. An activation threshold of the hydraulic drive component 220 is thus realized by means of the gap 214 formed between the two transmission elements 213, 223. Here, the gap width determines the maximum valve needle stroke that can be realized without activation of the hydraulic drive 220. A corresponding activation threshold may however also be realized by means of corresponding tolerances at other points in the mechanical transmission path, which includes the two transmission elements 213, 223, from the electric drive component 210 to the valve element 221.

Figure 2:
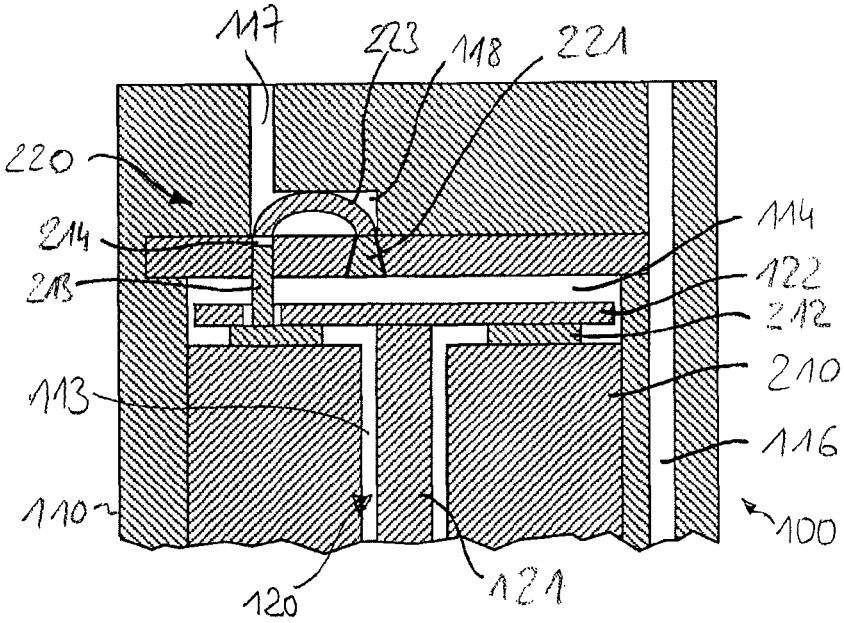
FIG. 2 shows the drive device of the injection valve apparatus of FIG. 1 in a rest position.

An example mode of operation of the disclosed valve apparatus will be described in more detail below. In this regard, FIG. 2 shows a detail of the drive device 200 from FIG. 1. To ensure that the valve needle sealingly closes off the nozzle orifice when the injection valve is in the closed state, the plate-like termination element 122 of the valve needle 120 does not bear directly against the annular element 212. The two elements are rather separated from one another by a small gap, which defines a so-called idle stroke. Only after the idle stroke is overcome do the two elements come in contact with one another (not shown here). FIG. 2 illustrates the initial situation in which the valve needle 120 is pressed into the valve seat by the force of the compression spring 130 and consequently holds the injection nozzle closed. Since the entire valve needle chamber 113 communicates hydraulically with the high-pressure duct 116, the high fuel pressure also prevails in the pressure chamber 114 at this time. Since the servo valve 220 is also still closed, the pressure conditions in the entire pressure chamber 114, that is to say above and below the plate-like termination element 122 of the valve needle 120, are substantially balanced.

Figure 3:
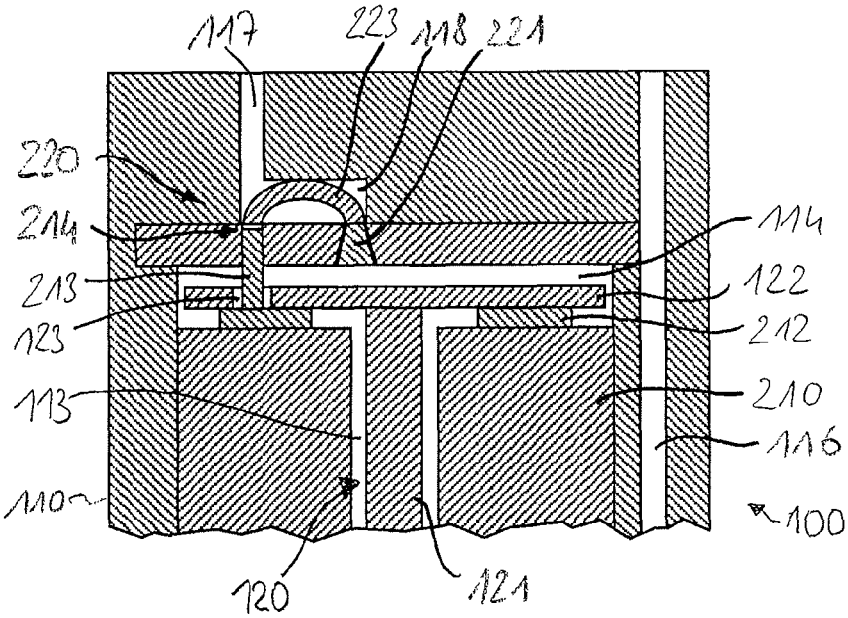
FIG. 3 shows the drive device of FIG. 2, with a valve needle deflected slightly by means of the direct drive.

By activation of the direct drive, which is realized in the present example by application of a corresponding electric voltage to the piezo stack, the piezo actuator 210 expands in the direction of the valve needle plate 122. After the idle stroke is overcome, the valve needle plate 122 is driven by the annular element 212, which leads to a deflection of the valve needle 120 out of its rest position. A corresponding situation is illustrated in FIG. 3. It can be seen here that a small deflection of the valve needle 120 reduces the gap width 214 between the two transmission elements 213, 223 without the servo valve 220 being activated. Therefore, by application of a correspondingly low voltage to the piezo stack 210, it is possible to effect a precise opening of the injection valve, for example in order to inject an extremely small fuel quantity into the combustion chamber during the pilot injection.

Figure 4:
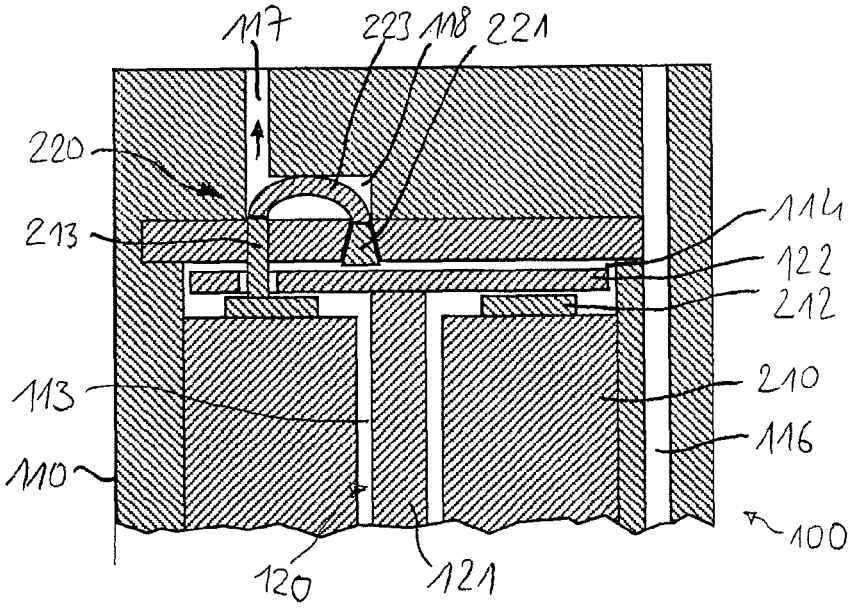
FIG. 4 shows the drive device of FIGS. 2 and 3 in servo operation, with a valve needle in ballistic flight.

By contrast, if an adequately high voltage is applied to the direct drive 210, a correspondingly large expansion of the piezo stack results in contact between the two transmission elements 213, 223 and subsequently in activation of the servo valve 220, wherein the conical valve element 221 is raised out of its valve seat by means of the lever 223. Said situation is shown in FIG. 4. As a result of the opening of the servo valve 220, an abrupt pressure drop occurs in the upper part of the pressure chamber 114, because here, the pressurized liquid can escape through the servo valve 220 and the low-pressure duct 117 faster than it can flow in via the connection to the high-pressure duct 116. Since high pressure substantially still prevails at this time in the lower part of the pressure chamber 114, the sudden pressure drop in the upper part of the pressure chamber 114 causes a force to act on the valve needle plate 122, and consequently on the valve needle 120 as a whole, in the direction of the pressure gradient. In the second drive phase of the valve needle 120 initiated in this way, the valve needle plate 122 lifts up from the annular element 212 and, together with the valve needle 120 as a whole, covers a distance dependent on the respective hydraulic parameters in ballistic flight. The considerably greater deflection of the valve needle 120 during the ballistic flight phase generates a correspondingly large opening of the injection nozzle, as a result of which a greater liquid quantity is delivered. Said hydraulically assisted operating mode is thus particularly well suited for fuel injection during the main injection phase of an internal combustion engine.

When the pressure conditions within the pressure chamber 114 have been substantially compensated as a result of the follow-up inflow of liquid, the valve needle is forced back in the direction of the valve orifice by the compression spring 130 and the injection valve is closed again. Said process can be influenced by early closing of the servo valve 220, which may be effected by means of a corresponding contraction of the piezo stack 210. Here, the valve element 221 is pressed into its valve seat again by the pressure difference prevailing between the pressure chamber 114 and low-pressure duct 117, as a result of which the pressure drop via the low-pressure duct 117 is abruptly ended. Here, said closing process may be assisted by means of a spring element which presses the valve element 221 into its valve seat (not shown here).

Figure 5:
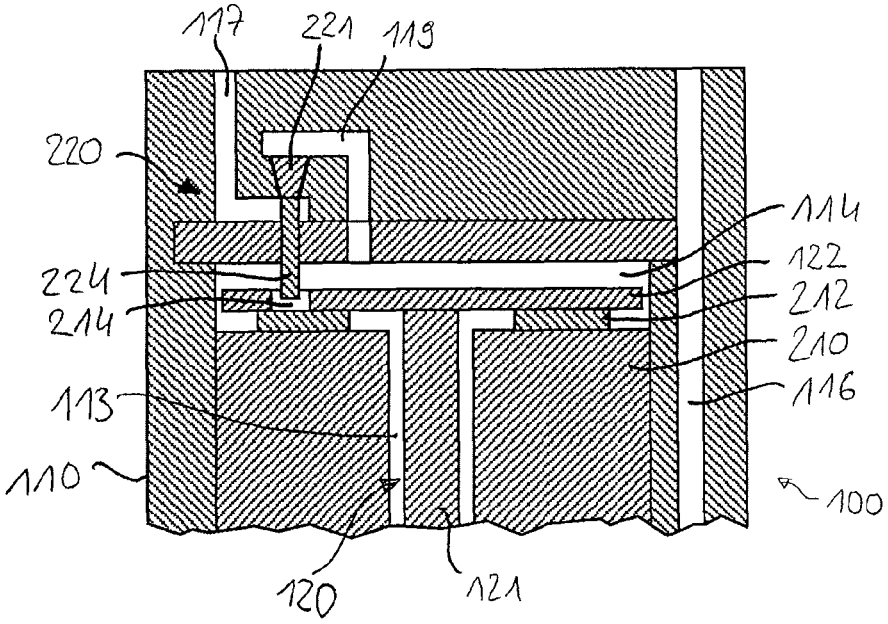
FIG. 5 shows a time diagram illustrating, by way of example, an injection process of the injection valve according to an example embodiment with pilot injection and main injection.

FIG. 5 shows a further alternative embodiment of the valve apparatus 100 according to an example embodiment, in which the valve needle 120 is likewise set in ballistic flight in a hydraulically assisted manner when the deflection of the valve needle 120 exceeds a predefined needle stroke. Here, the electric drive component 210 is designed substantially analogously to the corresponding drive component from FIGS. 1 to 4. By contrast to the exemplary embodiments shown in the preceding figures, the servo valve of the injection valve 200 shown here is however arranged such that the opening of the valve element 221 now takes place in the direction of expansion of the piezo stack 210. In this way, the deflection of the piezo element 210 can be transmitted directly to the valve element 221 by means of a simple pin-like transmission element 224. As shown in FIG. 5, the transmission element 224 is in this case not seated directly on the annular element 214. The gap 214 provided between the two elements 212, 224 correspondingly determines the activation threshold, that is to say the maximum distance by which the valve needle 120 can be deflected only by means of the direct drive 210 without assistance by the hydraulic drive component 220. When the activation threshold is reached, contact occurs between the annular element 212 and the transmission element 224, which, during a further deflection of the piezo stack 210, leads to the valve element 221 being lifted out of its valve seat. In this way, similarly to the first exemplary embodiment, a hydraulic connection of the pressure chamber 114 to the low-pressure duct 117 is produced through the duct 119 and the servo valve 220.

Figure 6:
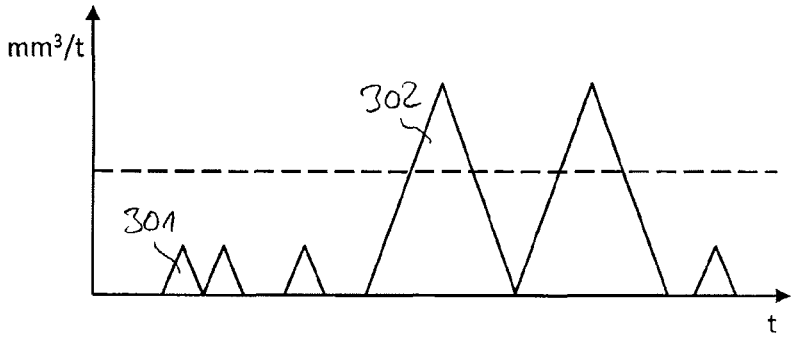
FIG. 6 shows a possible injection process, during which fuel is injected into the combustion chamber of an internal combustion engine in a plurality of individual injections by means of the injection valve.

FIG. 6 shows a possible injection process, during which fuel is injected into the combustion chamber of an internal combustion engine in a plurality of individual injections by means of the injection valve according to an example embodiment. Here, for the conditioning of the internal combustion engine small or extremely small fuel quantities 301 are injected already during the course of a pilot injection which takes place prior to the main injection. Here, the injection of extremely small quantities may take place in the purely electric operating mode in which the deflection of the valve needle is effected exclusively by the direct drive. For this purpose, the piezo actuator is activated only to a small extent, such that its small deflection does not lead to an activation of the servo valve. By contrast, during the subsequent main injection phase, a relatively high electrical voltage is applied to the piezo actuator in order to attain an activation of the servo valve as a result of the correspondingly large deflection of the piezo actuator. After activation of the servo valve, the valve needle attains a greater needle stroke in ballistic flight, which is manifested in considerably larger injection quantities 302.

The main injections may also be followed by so-called post-injections in order to increase the energy content of the exhaust gases for exhaust-gas aftertreatment. Since likewise only very small fuel quantities are injected into the combustion chamber during a post-injection, it is sufficient in this case for the injection valve to be opened only by means of the direct drive.

The embodiments explained on the basis of the figures constitute merely preferred or exemplary embodiments of the invention. In addition to the embodiments described and shown, further embodiments are conceivable which may encompass further modifications and combinations of features. In particular, the valve device disclosed here in conjunction with fuel injection may also be used for the delivery or metering of other lubricating or non-lubricating liquids.

What is claimed is:

1. A valve apparatus for delivering a liquid, comprising:
a housing,
a valve needle arranged such that it can be deflected in a valve needle chamber of the housing, and
a drive device for the valve needle, the drive device comprising:
a direct electric drive component comprising a piezo stack which expands to effect a direct deflection of the valve needle, and
an activatable hydraulic drive component configured to cause a deflection of the valve needle, the hydraulic drive component comprising a servo valve connecting the valve needle chamber to a low-pressure duct, the servo valve comprising a valve element moveable from a closed position into an open position by expansion of the direct electric drive component piezo stack,
wherein the expansion of the direct electric drive component piezo stack leads to an activation of the hydraulic drive component after an activation threshold is overcome, the activation threshold defined by a distance the direct electric drive component must move to close a space separating components of a mechanical linkage from the direct electric drive component piezo stack to the valve element.

2. The valve apparatus of claim 1, wherein the mechanical linkage from the direct electric drive component piezo stack to the valve element comprises at least one mechanical transmission element which transmits the expansion of the direct electric drive component piezo stack to the valve element of the hydraulic drive component.

3. The valve apparatus of claim 2, wherein the transmission element has a pin-like form.

4. The valve apparatus of claim 3, wherein the mechanical linkage comprises a lever-like transmission element which is actuated by the pin-like transmission element.

5. The valve apparatus of claim 1, wherein the direct electric drive component piezo stack expands when an electrical voltage is applied.

6. The valve apparatus of claim 1, wherein the direct electric drive component piezo stack is operated using closed loop regulation.

7. The valve apparatus of claim 1, wherein the valve apparatus comprises an injection valve for injecting fuel into a combustion chamber of an internal combustion engine.

8. An internal combustion engine comprising:
a combustion chamber, and
an injection valve for injecting fuel into the combustion chamber, the injection valve comprising:
a housing,
a valve needle arranged such that it can be deflected in a valve needle chamber of the housing, and
a drive device for the valve needle, the drive device comprising:
a direct electric drive component piezo stack which effects a direct deflection of the valve needle, and
an activatable hydraulic drive component configured to cause a deflection of the valve needle, the hydraulic drive component comprising a servo valve connecting the valve needle chamber to a low-pressure duct, the servo valve comprising a valve element moveable from a closed position into an open position by the expansion of the direct electric drive component piezo stack,
wherein the expansion of the direct electric drive component piezo stack leads to an activation of the hydraulic drive component after an activation threshold is overcome, the activation threshold defined by a distance the direct electric drive component must move to close a space separating components of a mechanical linkage from the direct electric drive component to the valve element.

9. The engine of claim 8, wherein the mechanical linkage from the direct electric drive component piezo stack to the valve element comprises at least one mechanical transmission element which transmits the expansion of the direct electric drive component piezo stack to the valve element of the hydraulic drive component.

10. The engine of claim 9, wherein the transmission element has a pin-like form.

11. The engine of claim 10, wherein the mechanical linkage comprises a lever-like transmission element which is actuated by the pin-like transmission element.

12. A valve apparatus for delivering a liquid, comprising:
a housing,
a valve needle arranged such that it can be deflected in a valve needle chamber of the housing, and
a drive device for the valve needle, the drive device comprising:
an electric drive component which effects a direct deflection of the valve needle,
an activatable hydraulic drive component configured to cause a deflection of the valve needle, the hydraulic drive component comprising a servo valve connecting the valve needle chamber to a low-pressure duct, the servo valve comprising a valve element moveable from a closed position into an open position by the deflection of the electric drive component,
wherein the deflection of the electric drive component leads to an activation of the hydraulic drive component after an activation threshold is overcome, the activation threshold predefined by a tolerance in a mechanical transmission path from the electric drive component to the valve element, the mechanical transmission path from the electric drive component to the valve element comprises at least one mechanical transmission element which transmits the deflection of the electric drive component to the valve element of the hydraulic drive component, the transmission element having a pin-like form.

13. The valve apparatus of claim 12, wherein the mechanical transmission path comprises a lever-like transmission element which is actuated by the pin-like transmission element.

14. The valve apparatus of claim 13, wherein a tolerance is provided between the two transmission elements which permits a deflection of the valve needle by a predefined distance without an activation of the hydraulic drive component taking place.

15. The valve apparatus of claim 12, wherein the electric drive component comprises a piezo element which effects the deflection when an electrical voltage is applied.

16. The valve apparatus of claim 12, wherein the electric drive component is operated using closed loop regulation.

17. The valve apparatus of claim 12, wherein the valve apparatus comprises an injection valve for injecting fuel into a combustion chamber of an internal combustion engine.

* * * * *